US009823616B2

(12) United States Patent
Endo

(10) Patent No.: US 9,823,616 B2
(45) Date of Patent: Nov. 21, 2017

(54) IMAGE HEATING UNIT HAVING AN ELECTRICAL SUBSTRATE MOUNTED ON A SURFACE OF AN OUTERMOST WALL

(71) Applicant: CANON KABUSHIKI KAISHA, Tokyo (JP)

(72) Inventor: Michiaki Endo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/242,815

(22) Filed: Aug. 22, 2016

(65) Prior Publication Data

US 2017/0060069 A1 Mar. 2, 2017

(30) Foreign Application Priority Data

Aug. 31, 2015 (JP) ..... 2015-170394

(51) Int. Cl.
*G03G 15/20* (2006.01)
*G03G 15/00* (2006.01)

(52) U.S. Cl.
CPC ..... *G03G 15/80* (2013.01); *G03G 15/2017* (2013.01)

(58) Field of Classification Search
CPC ..... G03G 15/80; G03G 15/2017; G03G 15/2032; G03G 15/2035; G03G 15/2039
USPC ..... 399/12, 90, 122
See application file for complete search history.

(56) References Cited

U.S. PATENT DOCUMENTS 7,382,990 B2 * 6/2008 Park et al. ..... B41J 3/44 399/12
8,090,273 B2 * 1/2012 Derimiggio ..... G03G 15/2053 399/12

FOREIGN PATENT DOCUMENTS

JP 2006084996 A 3/2006
JP 2006227335 A 8/2006
JP 2009015018 A 1/2009
JP 2011197372 A 10/2011

OTHER PUBLICATIONS

European Search Report issued in corresponding European Application No. 16183304.1 dated Jan. 17, 2017.

* cited by examiner

*Primary Examiner* — William J Royer
(74) *Attorney, Agent, or Firm* — Fitzpatrick, Cella, Harper & Scinto

(57) ABSTRACT

An image heating unit detachably mountable to an image forming apparatus includes a pair of rotatable members configured to form a nip for heating a toner image formed on a recording material; an outermost wall positioned outside the rotatable members; and an electrical substrate including a storing element. The electrical substrate is mounted on an outer surface of the outermost wall so that the storing element faces the outer surface of the outermost wall with a predetermined gap therebetween.

6 Claims, 9 Drawing Sheets

IMAGE HEATING UNIT HAVING AN ELECTRICAL SUBSTRATE MOUNTED ON A SURFACE OF AN OUTERMOST WALL

FIELD OF THE INVENTION AND RELATED ART

The present invention relates to an image heating unit of an image heating apparatus for heating a toner image on a recording material. The image heating apparatus is used in an image forming apparatus such as a copying machine, a printer, a facsimile machine, a multi-function machine having a plurality of functions of these machines, or the like.

In the image forming apparatus, a fixing device (image heating apparatus) for fixing the toner image formed on the recording material is provided. In the image forming apparatus disclosed in Japanese Laid-Open Patent Application (JP-A) 2006-227335, the fixing device is assembled into a unit as a fixing unit (image heating unit) and is detachably mountable to the image forming apparatus. This is because the fixing device is exchanged (replaced). Further, to the fixing unit, a memory (storing element) is mounted and is configured to be capable of storing operation hysteresis. The memory is weak against heat, and therefore, the memory is disposed on a bottom of a casing of the fixing unit.

Such a memory is weak against a physical impact (shock) and is liable to damage. For that reason, in an image forming apparatus disclosed in JP-A 2009-15018, a constitution in which a memory provided on an outer surface of a fixing unit is covered with a protecting member is employed.

However, in the case of the constitution in which the memory is protected by the protecting member, an increase in cost of the image forming apparatus is invited, so that there is room for improvement.

SUMMARY OF THE INVENTION

According to an aspect of the present invention, there is provided an image heating unit detachably mountable to an image forming apparatus, comprising: a pair of rotatable members configured to form a nip for heating a toner image formed on a recording material; an outermost wall positioned outside the rotatable members; and an electrical substrate including a storing element, wherein the electrical substrate is mounted on an outer surface of the outermost wall so that the storing element faces the outer surface of the outermost wall with a predetermined gap therebetween.

Further features of the present invention will become apparent from the following description of exemplary embodiments with reference to the attached drawings.

DESCRIPTION OF THE EMBODIMENTS

Embodiments of the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, the scope of the present invention is not intended to be limited to the following embodiments.

First Embodiment (Image Forming Apparatus)

Figure 1:
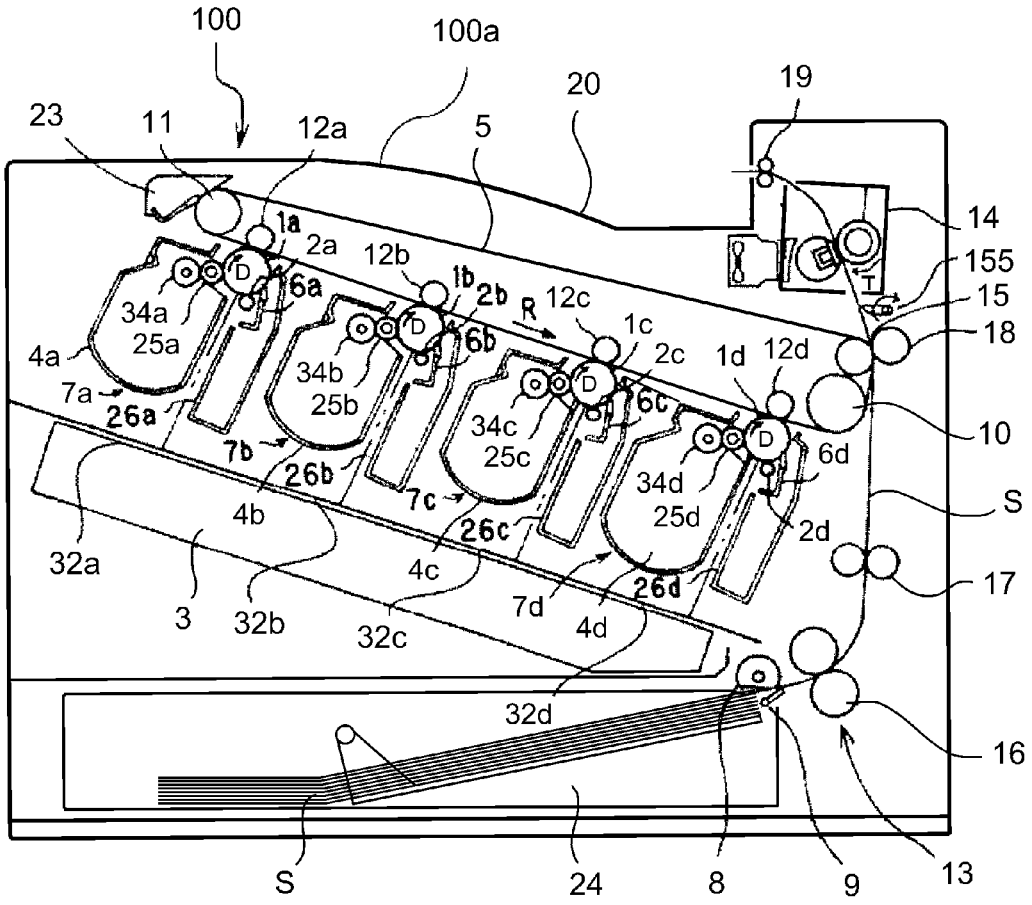
FIG. 1 is a principal sectional view of an image forming apparatus.

FIG. 1 is a schematic sectional view of an image forming apparatus main assembly 100*a* of an image forming apparatus 100 in a First Embodiment of the present invention. Four cartridges 7 (7*a*-7*d*) which are juxtaposed obliquely downwardly in the listed order include photosensitive drum units 26 (26*a*-26*d*) including photosensitive drums 1 (1*a*-1*d*) as electrophotographic photosensitive members, and developing units 4 (4*a*-4*d*).

The drums 1 are rotationally driven clockwisely (in a direction of an arrow D) in FIG. 1 by a driving member (not shown). At peripheries of the drums 1, in the order of a rotational direction thereof, cleaning members 6 (6*a*-6*d*), charging rollers 2 (2*a*-2*d*), and the developing units 4 are provided. The cleaning members 6 remove toner agents remaining on the drums 1 after the toner images are transferred from the drums 1 onto an intermediary transfer belt 5. The toner agents removed by the cleaning members 6 are collected in toner chambers in photosensitive member units 26 (26*a*-26*d*).

The charging rollers 2 electrically charge surfaces of the drums 1 uniformly. After the surfaces of the drums 1 are charged by the charging rollers 2, the surfaces of the drums 1 are exposed to laser light from a scanner unit (exposure means) 3 through unit openings 32 (32*a*-32*d*). As a result, electrostatic latent images are formed on the surfaces of the drums 1. In this embodiment, the scanner unit 3 is disposed below the cartridge 7.

The developing units 4 supply the toner agents to the electrostatic latent images formed on the drums 1 and develop the electrostatic latent images into the toner images. The developing units 4 include developing rollers 25 (25*a*-25*d*) for supplying the toner agents to the surfaces of the drums 1 in contact with the drums 1 and supplying rollers 34 (34*a*-34*d*) for supplying the toner agents to the surfaces of the developing rollers 25 in contact with the developing rollers 25.

When the image is formed on a recording material S, first, the electrostatic latent images formed on the surfaces of the photosensitive drums 1 by the scanner unit 3 are developed into the toner images by the cartridges 7 and then are transferred onto the intermediary transfer belt 5. The intermediary transfer belt 5 is stretched by a driving roller 10 and a tension roller 11 and is driven in an arrow R direction in FIG. 1. Inside the intermediary transfer belt 5, primary transfer rollers 12 (12*a*-12*d*) are provided opposed to the drums 1, and to the primary transfer rollers 12, transfer biases are applied by unshown bias applying means.

For example, in the case where negatively charged toner agents are used, by applying positive biases to the primary transfer rollers 12, the toner images are successively transferred onto the intermediary transfer belt 5. Then, the four color toner images are fed to a secondary transfer portion 15 in a state in which four color toner images are superposed on the intermediary transfer belt 5. At this time, the toner agents remaining on the intermediary transfer belt 5 after the secondary transfer onto the recording material S are removed by a transfer belt cleaning device 23, and the removed toner agents pass through a residual (waste) toner feeding path (not shown) and are collected by a residual (waste) toner collecting container (not shown).

On the other hand, in synchronism with an image forming operation described above, the recording material S is fed toward the secondary transfer portion 15 by a feeding mechanism including a feeding device 13, a registration roller pair 17 and the like. The feeding device 13 includes a feeding cassette 24 for accommodating a plurality of recording materials S, a feeding roller 8 and a feeding roller pair 16 for feeding the fed recording material S. The feeding cassette 24 is detachably mountable to the image forming apparatus main assembly 100*a*. When a user pulls out the feeding cassette 24, demounting the feeding cassette 24 from the image forming apparatus main assembly 100*a*, and then sets the recording materials S in the feeding cassette 24 and inserts the feeding cassette 24 into the image forming apparatus main assembly 100*a*, supply of the recording materials S is completed.

Of the recording materials S accommodated in the feeding cassette 24, the recording material S located in an uppermost portion is separated one by one by press-contact of the feeding roller 8 and a separation pad 9 with rotation of the feeding roller 8 (friction separation type), and then is fed. The recording material S fed from the feeding device 13 is fed to the secondary transfer portion 15 by the registration roller pair 17. At the secondary transfer portion 15, by applying a positive bias to a secondary transfer roller 18, it is possible to secondary-transfer the four color toner images from the intermediary transfer belt 5 onto the fed recording material S.

Then, the recording material S is fed from the secondary transfer portion 15 to a fixing device (fixing apparatus) 14, in which heat and pressure are applied to the images transferred on the recording material S, so that the images are fixed on the recording material S. The presence or absence of the recording material S in the fixing device 14 is detected by a feeding (device) entrance sensor 155 provided between the secondary transfer portion 15 and the fixing device 14. Thereafter, the recording material S on which the toner images are fixed is discharged onto a discharge tray 20 by a discharging roller pair 19.

(Fixing Device as Image Heating Apparatus)

Figure 2:
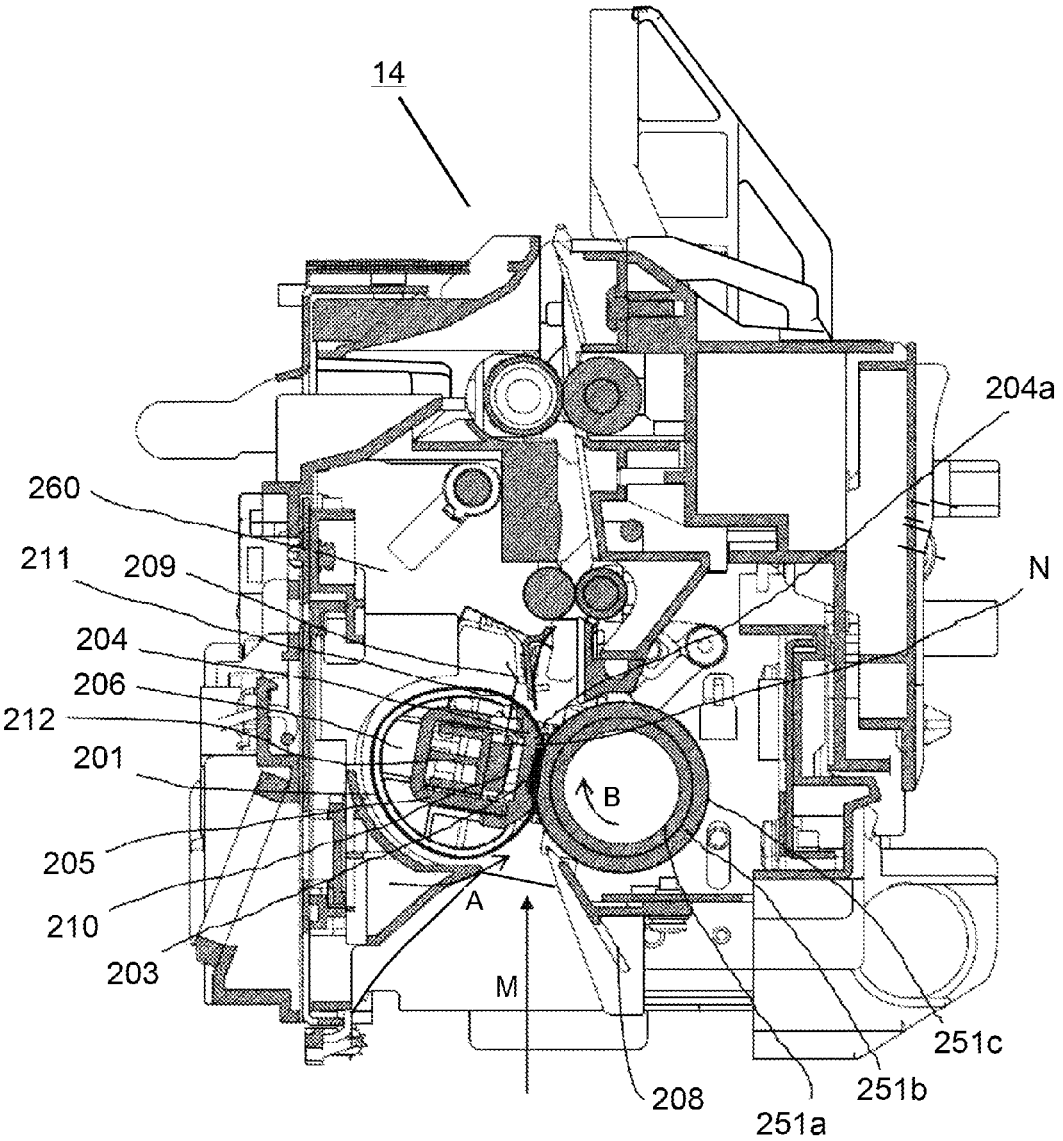
FIG. 2 is a principal sectional view of a fixing device.

FIG. 2 is a principal sectional view of the fixing device 14 (FIG. 1) as an image heating apparatus including an image heating unit according to this embodiment of the present invention, which is detachably mountable to the image forming apparatus main assembly 100*a* (FIG. 1).

1) Mounting and Demounting of Image Heating Unit Relative to Image Forming Apparatus Of constituent elements functioning as the fixing device 14 as the image heating apparatus, constituent elements excluding a control circuit and a power source circuit are assembled into a unit as a fixing unit (image heating unit). In a state in which a door of the image forming apparatus main assembly 100*a* is opened, the fixing unit is pulled out and thus can be demounted from a fixing device frame 260. The thus demounted fixing unit can be subjected to maintenance such as jam clearance.

Further, by mounting a fixing unit for exchange to a unit supporting portion, the fixing unit can be exchanged, and the fixing unit mounted to the unit supporting portion is electrically connected with the power source circuit of the image forming apparatus 100 and functions as the fixing device 14. Incidentally, in the case where a fixing film unit 310 (FIG. 3) constitutes a part of the fixing unit, and which is described later, first, demounting of the fixing unit is made. The fixing film unit 310 is provided with an IC chip substrate 307 (FIG. 3), described later, and is capable of being communicating with the image forming apparatus main assembly 100*a*.

2) Specific Structure of Fixing Device

The fixing device 14 in this embodiment shown in FIG. 2 includes a fixing film (endless belt) 201 and a pressing roller 251 (251*a*, 251*b*, and 251*c*). Further, the fixing device 14 includes a ceramic heater 203 as a heating member. Further, the fixing device 14 includes a heater holder 204 for holding the ceramic heater 203, a T-stay 205 for urging the ceramic heater 203 through the fixing film 201, and fixing flanges 206 and 207 (FIG. 3) for stably rotating a locus of the fixing film 201. The pressing roller 251 and the fixing film 201 contacting the ceramic heater 203 form a nip N.

The recording material (sheet) S is introduced from an arrow M direction (transfer portion of the image forming apparatus 100) of FIG. 2 to the nip N by an entrance guide 208 in a state in which an unfixed image is placed thereon. Then, in the nip N, the unfixed image is heated and pressed and thus is fixed on the recording material S. The recording material S passed through the nip N is discharged to an outside of the fixing device 14. At that time, a separation plate 209 is provided at a portion downstream of the nip N with respect to a feeding direction of the recording material S so that the recording material S can be smoothly separated from the fixing film 201.

These members will be specifically described below.

The fixing film 201 is a film for permitting heat conduction to the recording material S. The recording material S is passed through the nip N. An inner diameter of the fixing film 201 is set at 30 mm, and an inner peripheral length of the fixing film 201 is set so as to be 102% of a length of fixing film inner periphery regulating parts consisting of the ceramic heater 203, the heater holder 204, and the fixing flange 206, so that the fixing film 201 is loosely fitted onto these parts. The fixing film 201 is a composite layer film obtained by coating a PFA tube on an outer peripheral surface of a 50 μm-thick film of polyamideimide, but may also be formed of metal.

The ceramic heater 203 has a basic structure, including an elongated thin plate-like ceramic substrate and an energization heat generation resistor layer formed on a surface of the substrate, and is a low thermal capacity heater which increases in temperature with an abrupt temperature rise characteristic, as a whole, by energization to the heat generation resistor layer.

The heater holder 204 realizes back-up of the ceramic heater 203 to the fixing film 201, pressure application to the nip N formed by the press-contact of the pressing roller 251 with the fixing film 201, and feeding stability of the fixing film 201 during rotation of the fixing film 201. The heater holder 204 is required to have sliding, heat-resistant and heat-insulating characteristics, and is formed of a liquid crystal resin material.

The ceramic heater 203 is provided on the heater holder 204 by being fixed using a heat-resistant adhesive. In a downstream side of the heater holder 204 with respect to the recording material direction, a projection 204*a* (FIG. 2) is provided for the purpose of enlarging the feeding nip and improving a separation property of the recording material S from the fixing film 201.

The T-stay 205 provides strength to the heater holder 204 and the ceramic heater 203 by being pressed against the heater holder 204 in a side opposite from the ceramic heater 203, so that the nip N is ensured. In addition, the T-stay 205 is connected with the fixing flanges 206 and 207, so that strength of the fixing film unit 310 (FIG. 3) is ensured.

As a material of the T-stay 205, a 2.3 mm-thick electroplated zinc steel plate (sheet) is used, and the T-stay 205 is molded in a "U"-shape and is used so as to ensure strength.

The fixing flanges 206 and 207 (FIG. 3) are engaged with the T stay 205 and the heater holder 204 at both ends with respect to a longitudinal direction. Further, the fixing flanges 206 and 207 partly slide with an inner peripheral surface of the fixing film 201 and determine not only a locus of the fixing film 201 with respect to a rotational direction but also longitudinal portions of the fixing film 201 in the fixing device 14 by being abutted against front and rear end portions of the fixing film 201. As a material of the fixing flanges 206 and 207, a liquid crystal resin material having both of a heat resistant property and a sliding property in combination. These fixing flanges 206 and 207 are engaged with and held by the fixing device frame 260 (FIG. 2).

In a space surrounded by the T-stay 206 and the heater holder 204, a heater thermistor 210 as a temperature detecting element for temperature-controlling the ceramic heater 203 and a film thermistor 211 for detecting a film temperature are supported by a thermistor holder 212 and are disposed. The film thermistor 211 is mounted to a free end of a flexible leaf spring and is operable correspondingly to motion of the fixing film 201, and a fixed end is directly fixed to the thermistor holder 212.

The film thermistor 211 is mounted inside the fixing film 201 so as to be firmly attracted to an inner surface of the fixing film 201. In FIG. 2, for convenience, the film thermistor 211 is shown in a projected state from the fixing film 201 since the film thermistor 211 is less discriminable on the drawing (FIG. 2).

The heater thermistor 210 is fixed to a thermistor spring holder (not shown) and is pressed from the thermistor holder 212 by a spring, so that the heater thermistor 210 is pressed against a surface of the ceramic heater 203 where the ceramic heater 203 does not slide with the fixing film 201 with a pressing force of 1.96 N (0.2 kgf).

By a combination of the parts described specifically above, the fixing film unit 310 is formed. The fixing film unit 310 is one of units in the fixing device 14. Further, in the case where the fixing film 201 or the like reaches an end of a lifetime thereof in the market, or in the case where exchange of the fixing film 201 is required due to an accidental trouble, the fixing film unit 310 is exchanged.

Here, the pressing roller 251 as the pressing member provided in a side opposing the fixing film unit 310 uses the following material as a material thereof. That is, in FIG. 2, a metal core 251*a* is formed of mild steel, an elastic material layer 251*b* which is integrally molded and coated concentrically on an outer peripheral surface of the metal core 251*a* is formed of a silicone rubber, and a parting layer 251*c* as a surface layer is formed of a PFA tube. An outer diameter of the pressing roller 251 is 30 mm.

The fixing film 201 is rotated in an arrow A direction (FIG. 2) by rotation of the pressing roller 251 in an arrow B direction (FIG. 2) by a driving device of the image forming apparatus main assembly 100*a*. At this time, the fixing film 201 slides with the ceramic heater 203, so that a sliding resistance is generated between the fixing film 201 and the heater 203. Onto a sliding portion between the fixing film 201 and the ceramic heater 203, fluorine containing grease having a heat resistant characteristic is applied. The pressing roller 251 rotates against the sliding resistance and thus feeds the recording material S.

The fixing film 201 and the pressing roller 251 which form the nip N deteriorate with passing (fixing process) of the recording material S, and are exchanged after a predetermined number of recording materials have been subjected to the fixing process. In this embodiment, the fixing film 201 and the pressing roller 251 are exchanged every passing of 300,000 sheets of A4 sized recording materials. In this way, it is desirable that the fixing device 14 is periodically demounted from the image forming apparatus main assembly 100*a* and thus maintenance is enabled.

(Fixing Film Unit as Exchange Unit)

1) Structure of Fixing Film Unit

Figure 3:
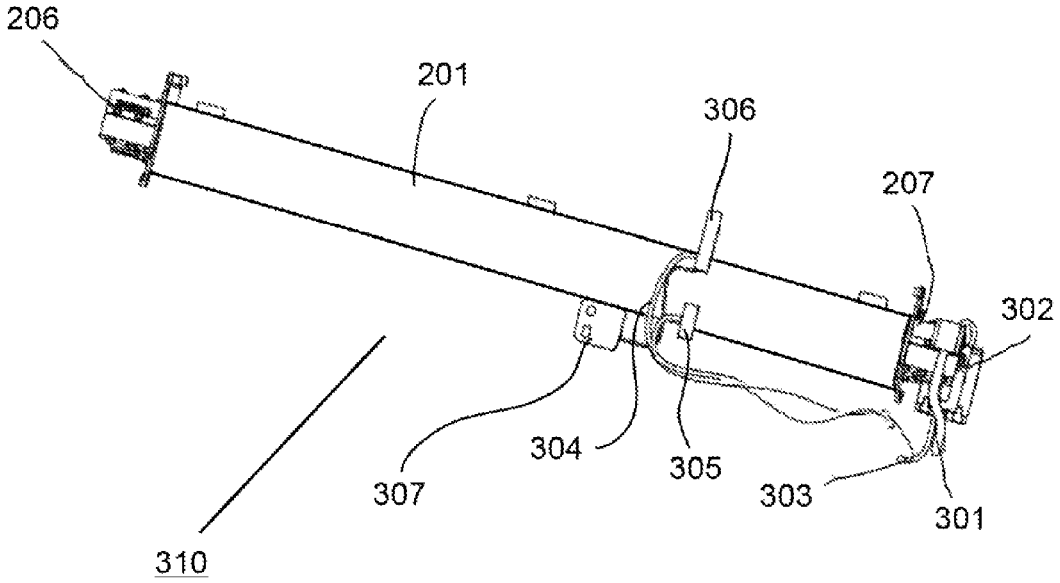
FIG. 3 is a schematic view of a fixing film unit as an exchange unit.

An outer appearance of the fixing film unit 310 as an exchange unit is shown in FIG. 3. At longitudinal end portions of the fixing film 201, the fixing flanges 206 and 207 are mounted, so that movement of the fixing film 201 in a thrust direction is prevented. To the fixing flange 207 side, an AC connector 302 functioning as an AC wire 301 and electrical contact which are used for supplying electric power to the ceramic heater 203 is mounted.

Further, in the fixing flange 207 side, bundle wires 303 and 304 as wiring portions connected with the heater thermistor 210 and the film thermistor 211 which are disposed inside the fixing film 201 come out of the inside of the fixing film 201, and with free ends thereof, connectors 305 and 306 are connected. Further, with the connector 306, the IC chip substrate 307 is connected via a bundle wire. The IC chip substrate 307 is fastened to the fixing device frame 260 (FIG. 2) with a screw. In this way, the IC chip substrate 307 as an electronic part (electric substrate) is connected with the fixing film unit 310 which is the exchange unit through wiring.

2) Mounting and Demounting of Fixing Film Unit

When the IC chip substrate 307 and the connectors 305 and 306 are demounted from the fixing device frame 260 (FIG. 2) which is a part of an outer wall of the fixing unit, an exchange cover as a part of the fixing device frame 260 can be demounted. When the exchange cover is demounted, the fixing film unit 310 is in an exposed state. In this embodiment, the IC chip substrate 307 is mounted to the exchange cover, and from the IC chip substrate 307, the bundle wire extends toward an inside of the fixing device 14. For that reason, unless the IC chip substrate 307 is demounted, the exchange cover cannot be demounted.

Then, the fixing film unit 310 is demounted. By demounting unshown urging (pressing) levers which urge (press) the fixing flanges 206 and 207 (FIG. 3), the fixing film unit 310 can be demounted from the fixing unit. That is, fixing by the urging levers can be eliminated. Here, the urging levers function as a fixing portion for fixing the fixing film unit 310 to the fixing unit. Here, a state in which the fixing film unit 310 cannot be demounted is referred to as a fixed state of the urging levers, and a state in which the fixing film unit 310 can be demounted is referred to as a released state of the urging levers.

The fixing film unit 310 is demounted so that the IC chip substrate 307 and other constituent elements are integrally demounted. Specifically, the IC chip substrate 307 is electrically and physically connected with the connectors 305 and 306 (FIG. 3) by the bundle wires (cables) 303 and 304 each including an electric power supply line and a signal line.

The connectors 305 and 306 are electrically and physically connected with the film thermistor 211 by the bundle wires 304 (cables) each including an electric power supply line and a signal line. That is, the bundle wires 304, the connectors 305 and 306, and the AC wire 301 and bundle wires 303 function as a connecting portion (connecting line, wire) for physically connecting the IC chip substrate 307 and the film thermistor 211 irrespective of a mounting and demounting state of the fixing film unit 310. Such a constitution is employed, and therefore, in the case where the fixing film 201 reaches the end of the lifetime thereof and the fixing film unit 310 is exchanged, so that the service person does not forget about collecting the IC chip substrate 307.

The connector and the bundle wire including the electric power supply line and the signal line are electrically connected with the heater thermistor 210 provided inside the fixing film 201.

(IC Chip Substrate)

1) Function of IC Chip Substrate

The IC chip substrate 307 is an electric substrate including an IC chip (storing element) in which inherent information of parts in the fixing film unit 310 and an operation (use) status of the fixing film unit 310 are stored. In the IC chip substrate 307 in this embodiment, information regarding individual differences of the thermistors and the heater is stored. As an example, in the case where a temperature of the fixing film 201 detected by the film thermistor 211 during inspection is lower than an actual temperature by 2° C., information indicating that an error of the film thermistor 211 is 2° C. is stored in the IC chip substrate 307 in advance.

Further, in the case where the temperature of the fixing film 201 after a lapse of a predetermined time from application of a predetermined voltage to the ceramic heater 203 during the inspection is higher than a target temperature by 2° C., information indicating that an error of the ceramic heater 203 is +2° C. is stored in the IC chip substrate 307 in advance.

The above described pieces of information are stored in general during assembling in a factory, but the image forming apparatus 100 may also be operated in an individual difference detecting mode for detecting the individual differences of the thermistor or the heater, and after execution of the operation in the individual difference detecting mode, the information stored in the IC chip substrate 307 may also be updated.

Further, a control circuit in the image forming apparatus 100 may also periodically store information on operation (use) hysteresis, such as an operation time of the fixing film 201 or the number of operations (the number of times of passing of sheets), in the IC chip substrate 307. Further, in general, the ceramic heater 203 may only be required to be written (stored) in the IC chip substrate 307 after an end of a job, but in consideration of the case where a power source of the image forming apparatus 100 is instantaneously interrupted, the ceramic heater 203 may also be written in the IC chip substrate 307 periodically during execution of the job.

When the above described pieces of information are stored in the IC chip substrate 307, even in an operation environment such that a plurality of image heating apparatuses (fixing devices) are used in rotation, the lifetime of the fixing film unit 310 can be properly measured. Then, the control circuit of the image forming apparatus 100 is capable of providing notification of the lifetime of the fixing film unit 310 at proper timing on the basis of the information stored in the IC chip substrate 307. The notification is made by displaying a message to the effect that the fixing film unit 310 reaches the end of the lifetime thereof and reaches the time for exchange (replacement) thereof at a display portion (not shown) such as a display.

Thus, into the IC chip substrate 307, the inherent information of the parts of the fixing film unit 310 and the like information are inputted, so that communication thereof with the image forming apparatus main assembly 100*a* is established, and it is possible to effect control depending on an individual fixing film unit characteristic. Further, durability hysteresis of the fixing film unit 310 can be outputted from the image forming apparatus main assembly 100*a*, so that it is also possible to analyze that the fixing film unit 310 exhibits that operation hysteresis.

2) Connection with Image Forming Apparatus Main Assembly

In this embodiment, the IC chip substrate 307 carries out electric signal communication with the image forming apparatus main assembly 100*a* in a state in which the IC chip substrate 307 is connected with the image forming apparatus main assembly 100*a* by the bundle wire, and therefore, in a process of the communication, the electric signal is prevented from being erroneously recognized due to superfluous noise or the like. Further, during collection of the fixing film unit 310 as the exchange unit, also the IC chip substrate 307 can be always collected (simultaneously with the fixing film unit 310).

3) Countermeasure Against Heat of IC Chip

The storing element such as the IC chip substrate 307 is weak against heat, and the lifetime thereof is shortened when the IC chip substrate 307 is subjected to a high temperature. Or, in a high-temperature environment, it is difficult to normally operate the IC chip substrate 307. A durable temperature of the IC chip substrate 307 is 90° C. or less, and a temperature recommended for a normal operation is less than 70° C. Therefore, in this embodiment, the IC chip substrate 307 is disposed in a place where a temperature is relatively low even during the fixing process.

4) First Surface and Back Surface of IC Chip Substrate

Figure 4:
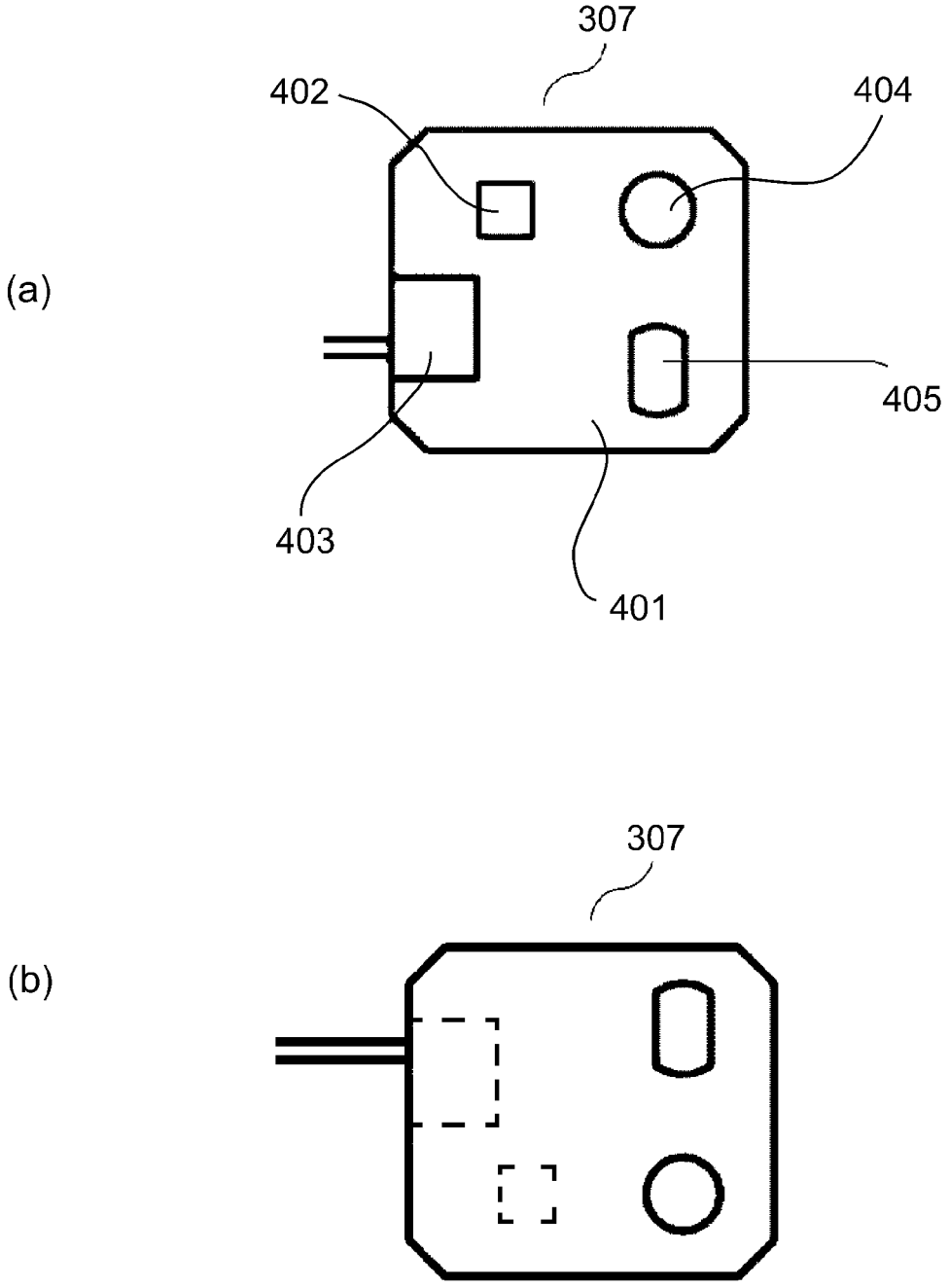
In FIG. 4, (a) is an illustration of a front surface of an IC chip substrate, and (b) is an illustration of a back (rear) surface of the IC chip substrate.

In FIG. 4, (a) and (b) show details of the IC chip substrate 307 as the electronic part. In FIG. 4, (a) and (b) shows a front surface and a back (rear) surface, respectively, of the IC chip substrate 307. The IC chip substrate 307 includes an electric substrate 401 as a base, and on the electric substrate 401, an IC chip 402 and a connector 403 are mounted on the same side (front surface side shown in (a) of FIG. 4). Thus, the IC chip 402 and the connector 403 are provided in the same (one) side of the electric substrate 401 (one side wiring correspondence), and in a side (back surface side shown in (b) of FIG. 4) of the electric substrate 401 opposite from the one side, there is no projection including the IC chip 402 and legs or the like of the connector 403.

Further, the electric substrate 401 is provided with a portioning hole 404 and a screw-fastening hole 405 for substrate fixing. The portioning hole 404 is a circular hole of 4 mm in diameter, and the screw-fastening hole 405 is an elongated hole of 3 mm in opening width with respect to a short side direction and 5 mm in opening width with respect to a long side direction. In this embodiment, these holes function as a preventing portion for preventing mounting of the IC chip substrate 307 in a reverse direction, so that the IC chip substrate 307 is prevented from being mounted in reverse.

(Unit for Image Forming Apparatus Detachably Mountable to Image Forming Apparatus Main Assembly)

In this embodiment, the fixing device 14 as a unit for the image forming apparatus 100 is detachably mountable to the image forming apparatus main assembly 100*a*. Using FIG. 5, an operation for demounting the fixing device 14 from the image forming apparatus main assembly 100*a* will be described.

Figure 5:
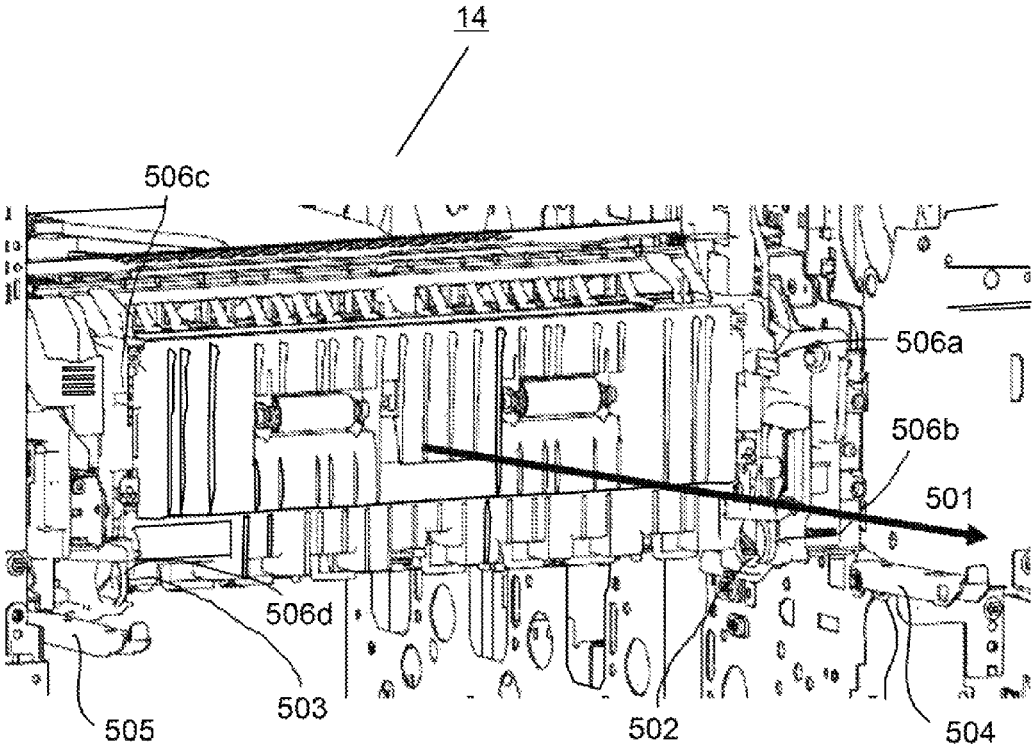
FIG. 5 is an illustration of demounting of the fixing device from an image forming apparatus main assembly.

In a right side of the fixing device 14 (FIG. 1), a rotatable door for performing jam clearance and maintenance of inside parts such as the fixing device 14 is provided as a right-hand door, and FIG. 5 shows a state in which the right-hand door (not shown) is opened. When the fixing device 14 is demounted, the fixing device 14 is pulled out in an arrow 501 direction while holding pulling-out group portions 502 and 503.

At that time, simultaneously with the pulling-out of the fixing device 14 from the image forming apparatus main assembly 100*a*, rotatable rails 504 and 505 are projected so that the fixing device 14 drops from the image forming apparatus main assembly 100*a*, and then the fixing device 14 is pulled out from the image forming apparatus main assembly 100*a* so as to slide on the rails 504 and 505. During an operation such as exchange of a periodical exchange unit or a periodical exchange part (e.g., the fixing film unit 310 or the like) of the fixing device 14, supporting portions 506*a*-506*d* are placed on a work bench, and then a necessary operation is performed.

Figure 6A:
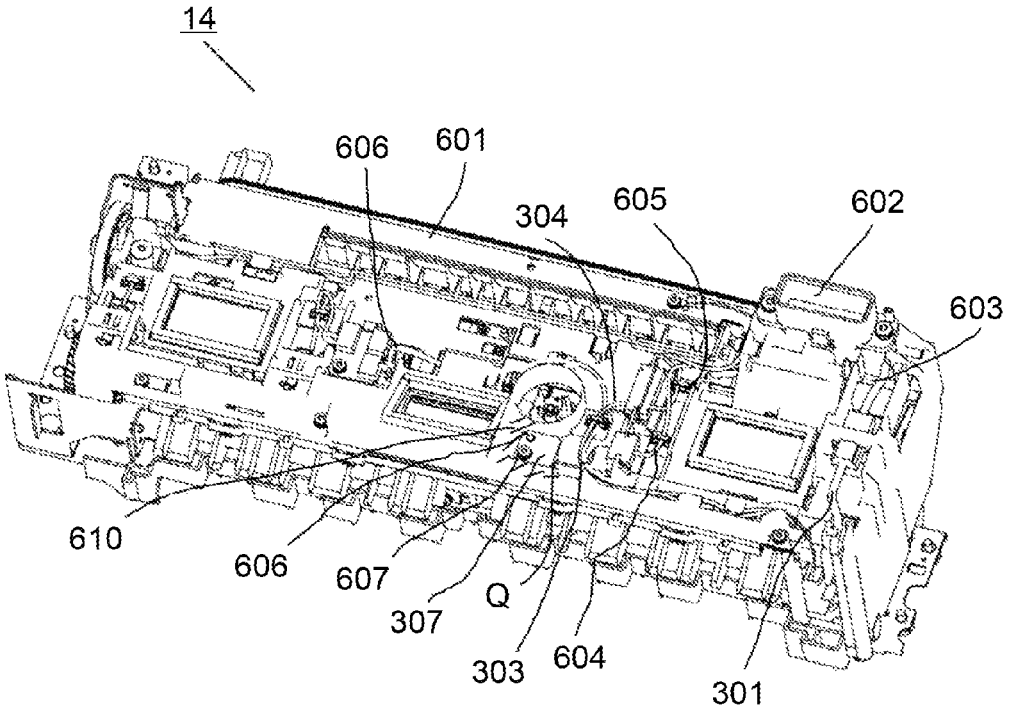
FIG. 6A is an illustration of mounting of the IC chip substrate to the fixing device.

FIG. 6A shows a basic attitude when the maintenance of the fixing device 14 or the exchange or the like of the periodical exchange unit or the periodical exchange part (the fixing film unit 310 or the like) inside the fixing device 14 is carried out, and is a schematic view of the fixing device 14 shown in FIG. 5 as seen from the image forming apparatus main assembly side. To a shutter unit 601 which is a small unit provided in the fixing device 14, a drawer unit 602 is mounted. The drawer unit 602 is used for connecting electric signals in the fixing device 14 altogether with the image forming apparatus main assembly 100*a*. From the drawer unit 602, an AC line 603 and signal lines 604, 605 and 606 are drawn.

An AC line 301 from the fixing film unit 310, a heat thermistor line 303 and a heat thermistor line 304 are connected with the AC line 603, the signal line 604 and the signal line 605, respectively, via the associated connector.

In FIG. 6A, at a peripheral portion of a region where the IC chip substrate 307 is mounted in the shutter unit 601, walls 610 are provided along three directions of 4 directions as seen from the IC chip substrate 307 side. The IC chip substrate 307 is mounted at a portion (outside portion of the unit) where the IC chip substrate 307 opens to an outside so as to be enclosed by these walls 610 and is fixed in a region where a fixing screw 607 is recessed from the walls 610 by being fastened to a portioning boss. Thus, the IC chip substrate 307 is mounted at the portion where the IC chip substrate 307 opens to the outside where heat dissipation is expected, so that the IC chip substrate 307 weak against heat is disposed at a preferable portion.

Here, as regards the mounting of the IC chip substrate 307, a side ((a) of FIG. 4) of the surface where the IC chip 402 of the electric substrate 401 as the base of the IC chip substrate 307 is mounted is a side ((a) of FIG. 4) which is out of sight (which is not exposed) when the IC chip substrate 307 is mounted to the fixing device 14. That is, the IC chip substrate 307 is mounted so that the side ((a) of FIG. 4) of the surface where the IC chip 402 is mounted is a rear side. Further, as shown in (b) of FIG. 4, there is no projection in the side opposite from the side where the IC chip 402 is mounted.

By employing such a constitution, an operating hand(s) or tool of the service person can be prevented from being accidentally touched on the IC chip substrate 307, so that it is possible to prevent breakage of the IC chip 402. At the recessed portion (a region indicated by Q in FIG. 6A) along one direction of the 4 directions as seen from the IC chip substrate 307 side functions as a finger inserting portion, through which the bundle wire coming out of the IC chip substrate 307 is passed, when the IC chip substrate 307 is demounted from the shutter unit 601.

In this embodiment, in the IC chip substrate 307, a difference in height (gap) between the electric substrate 401 and the outer (most) walls 610 is 5 mm. Further, in the IC chip substrate 307, a difference in height between the electric substrate 401 and a base surface of the shutter unit 601 is 10 mm. The height difference is 10 mm, and therefore, the IC chip substrate 307 is not readily influenced by heat and is caught by fingers of the service person, so that a mounting and demounting operation of the IC chip substrate 307 is facilitated.

Figure 6B:
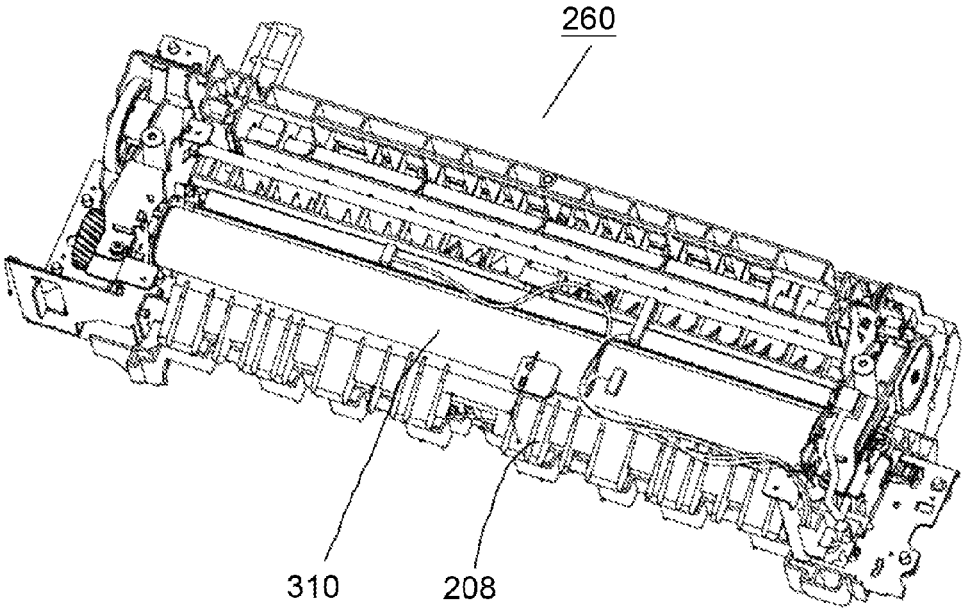
FIG. 6B is an illustration of a state in which a shutter unit is demounted from the fixing film unit.
Figure 6C:
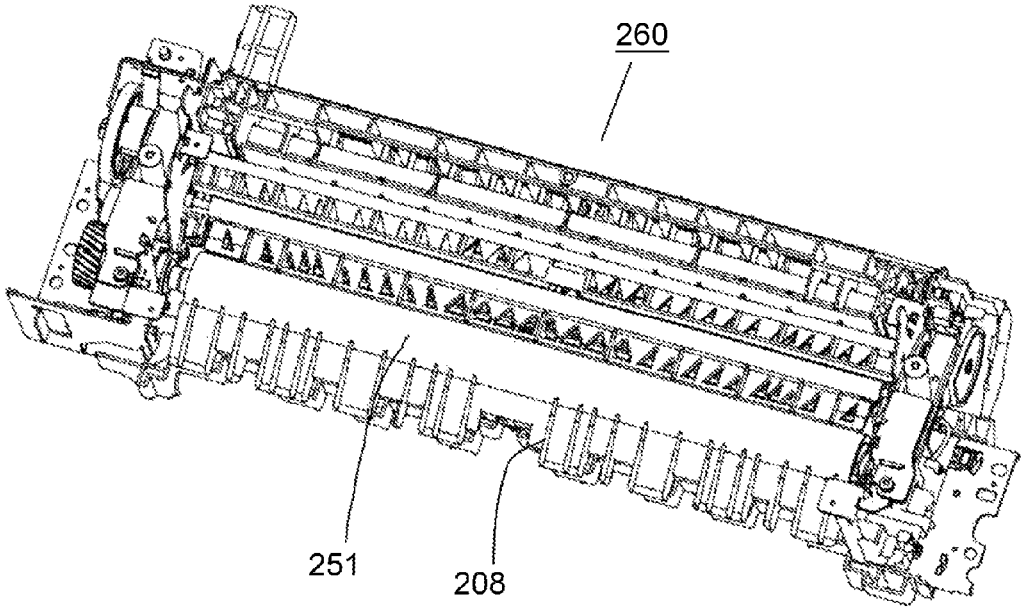
FIG. 6C is an illustration of a state in which the shutter unit and the fixing film unit are demounted from the fixing device.
Figure 6D:
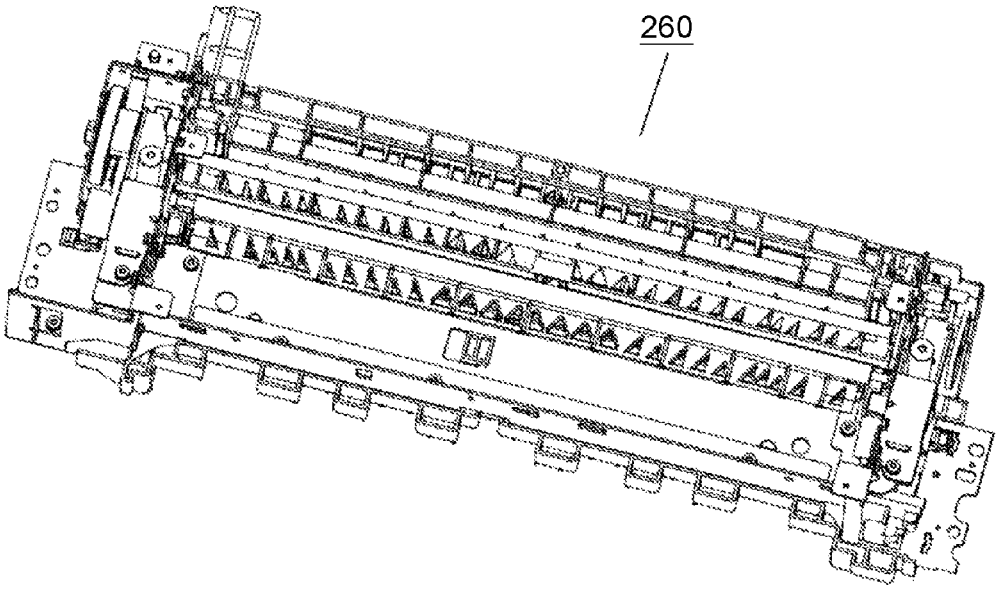
FIG. 6D is an illustration of a state of only a fixing frame, in which the shutter unit, the fixing film unit, a pressing roller and a fixing (device) entrance guide are demounted from the fixing device.

Next, using FIGS. 6B, 6C and 6D, demounting of the fixing film unit 310 and the pressing roller 251 from the fixing device 14 will be briefly described. FIG. 6B shows a state in which the shutter unit 601 is demounted from the fixing device 14. This state is in a pre stage in which the fixing film unit 310 is exposed on the fixing device frame 260 and is demounted from the fixing device 14.

FIG. 6C shows a state in which the fixing film unit 310 is demounted from the state of FIG. 6B. This state is in a pre stage in which the pressing roller 251 is exposed on the fixing device frame 260 and is demounted from the fixing device 14. FIG. 6D shows a state in which the shutter unit 601, the fixing film unit 310, the pressing roller 251 and the fixing (device) entrance guide 208 are demounted, i.e., a state in which only the fixing device frame 260 exists.

When the periodic exchange unit or the periodic exchange part is exchanged, an associated fresh (new) unit or part (component) is mounted in the reverse of the demounting described above, and finally, an operation for returning the fixing device 14 into the image forming apparatus main assembly 100*a* is performed. Thus, the fixing device 14 as the unit for the image forming apparatus 100 is detachably mountable to the image forming apparatus main assembly 100*a*.

According to this embodiment, in the case where the fixing device 14 is demounted from the image forming apparatus main assembly 100*a* and the part for maintenance or the like is exchanged, the service person is prevented from being accidentally touched on the IC chip 402, weak against impact (shock), with one's hand or a tool, so that it is possible to prevent breakage of the IC chip 402 resulting from the impact.

Second Embodiment

Similarly as in the first embodiment, also in this embodiment, a constitution in which in order to analyze exchange hysteresis of the periodic exchange part, the IC chip substrate 307 can be easily demounted and collected, and, during exchange of the part, the IC chip substrate 307 can be always collected simultaneously with the part is employed.

Figure 7:
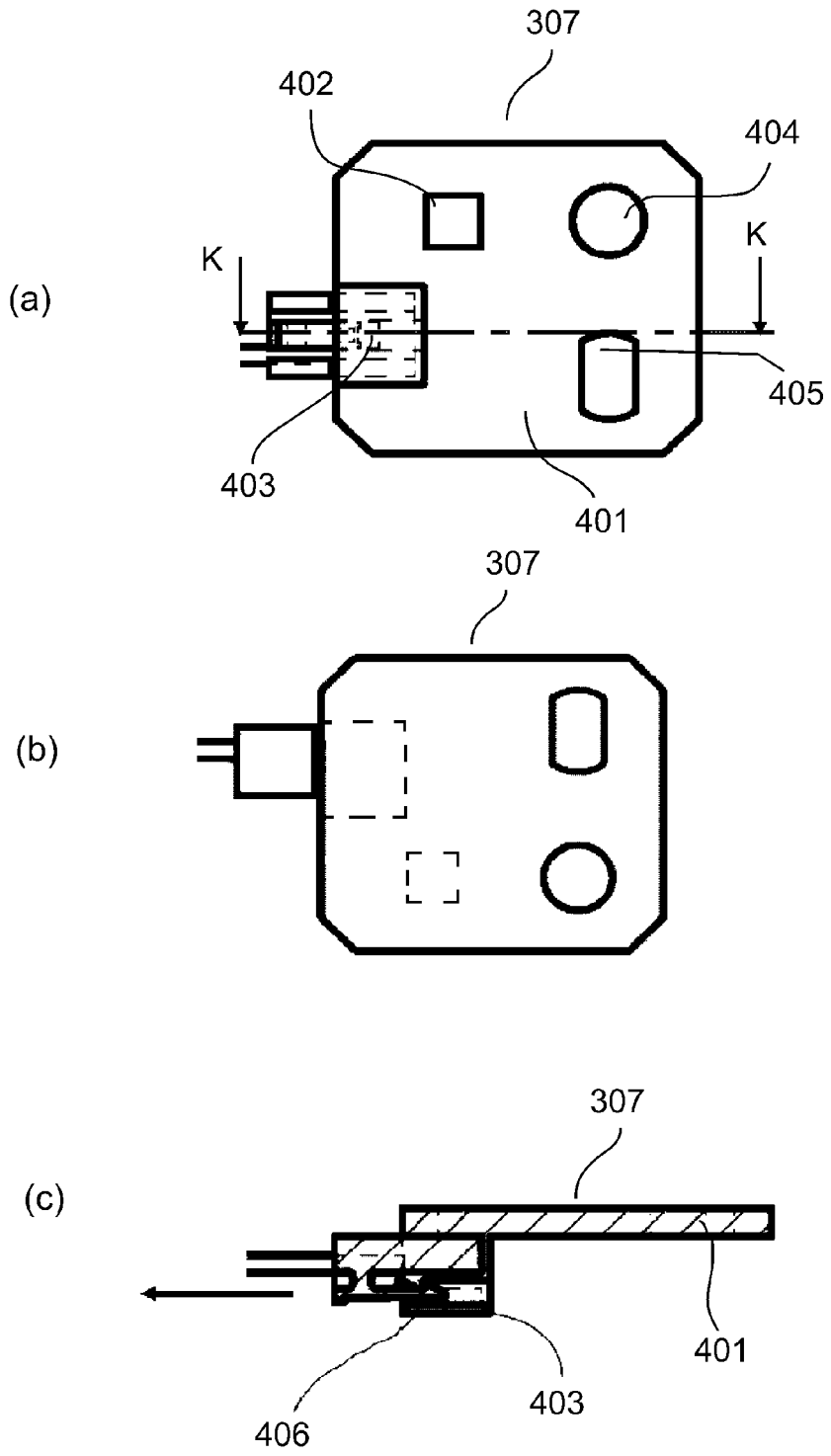
In FIG. 7, (a) is an illustration of a front surface of an IC chip substrate, (b) is an illustration of a back surface of the IC chip substrate, and (c) is an illustration of a snap fitted connector.

In this embodiment, a connector is used, and the periodical exchange part and the IC chip substrate are connected by the connector. Particularly in this embodiment, a constitution in which, as the connector, a connector of a snap fitting type is used, and, after the fixing film unit 310 is mounted to the fixing device 14, the service person cannot demount the snap fitted connector, is employed. In FIG. 7, (a) and (b) show a front surface and a back (rear) surface, respectively, of the IC chip substrate 307. The IC chip substrate 307 includes an electric substrate 401 as a base, and on the electric substrate 401, an IC chip 402 and a connector 403 are mounted on the same side (front surface side shown in (a) of FIG. 7). Thus, the IC chip 402 and the connector 403 are provided in the same (one) side of the electric substrate 401 (one side wiring correspondence), and in a side (back surface side shown in (b) of FIG. 7) of the electric substrate 401 opposite from the one side, there is no projection including the IC chip 402 and legs or the like of the connector 403.

In FIG. 7, (c) shows a K-K cross section of the IC chip substrate 307 shown in (a) of FIG. 7. The IC chip substrate 307 and the bundle wire are connected by the connector 403, and the connector 403 is of a snap-fitting type, so that the bundle wire is not disconnected from the connector 403 even when a force for pulling the bundle wire in a direction of an arrow is applied.

Also in this embodiment, similarly as in the First Embodiment, in FIG. 6A, at a peripheral portion of a region where the IC chip substrate 307 is mounted in the shutter unit 601, walls 610 are provided along three directions of 4 directions as seen from the IC chip substrate 307 side. The IC chip substrate 307 is mounted so as to be enclosed by these walls 610 and a fixing screw 607 is fastened to a portioning boss, so that a closed space is formed.

Here, as regards the mounting of the IC chip substrate 307, a side ((a) of FIG. 4) of the surface where the IC chip 402 of the electric substrate 401 as the base of the IC chip substrate 307 and the connector 403 are mounted is a side ((a) of FIG. 7) which is out of sight (which is not exposed) when the IC chip substrate 307 is mounted to the fixing device 14. That is, the IC chip substrate 307 is mounted so that the side ((a) of FIG. 7) of the surface where the IC chip 402 is mounted is a rear side. Further, as shown in (b) of FIG. 7, there is no projection in the side opposite from the side where the IC chip 402 is mounted.

By employing such a constitution, an operating hand(s) or tool of the service person can be prevented from being accidentally touched on the IC chip substrate 307, so that it is possible to prevent breakage of the IC chip 402. The recessed portion (a region indicated by Q in FIG. 6A) along one direction of the 4 directions, as seen from the IC chip substrate 307 side, functions as a finger inserting portion, through which the bundle wire coming out of the IC chip substrate 307 is passed, when the IC chip substrate 307 is demounted from the shutter unit 601.

Also in this embodiment, in the IC chip substrate 307, a difference in height between the electric substrate 401 and the walls 610 is 5 mm. Further, in the IC chip substrate 307, a difference in height Y ((b) of FIG. 8) between the electric substrate 401 and a base surface corresponding to a region indicated by Q (FIG. 6A) of the shutter unit 601 is 10 mm. The height difference Y is 10 mm, and therefore, the IC chip substrate 307 is caught by fingers of the service person, so that a mounting and demounting operation of the IC chip substrate 307 can be easily performed.

Further, a distance between the snap fitted portion claw portion) of the connector on the substrate and the base surface of the shutter unit 601 is a gap (spacing) in which a test finger (JIS C 0922, probe code B) cannot enter.

That is, the wiring portion includes one connector portion mounted to an electronic circuit substrate, the other connector portion provided detachably mountable to the one connector portion, and a preventing portion for preventing disconnection of the other connector portion from the one connector portion. The prevention of the preventing portion can be eliminated by being urged, and a gap (distance) between the preventing portion and a shielding member 700 ((b) of FIG. 8) is a gap in which the test finger cannot enter.

The preventing portion includes a groove portion provided on the one connector portion and a claw portion provided on the other connector portion, and the claw portion is placed in an urged state, so that the other connector portion is demountable from the one connector portion.

Figure 8:
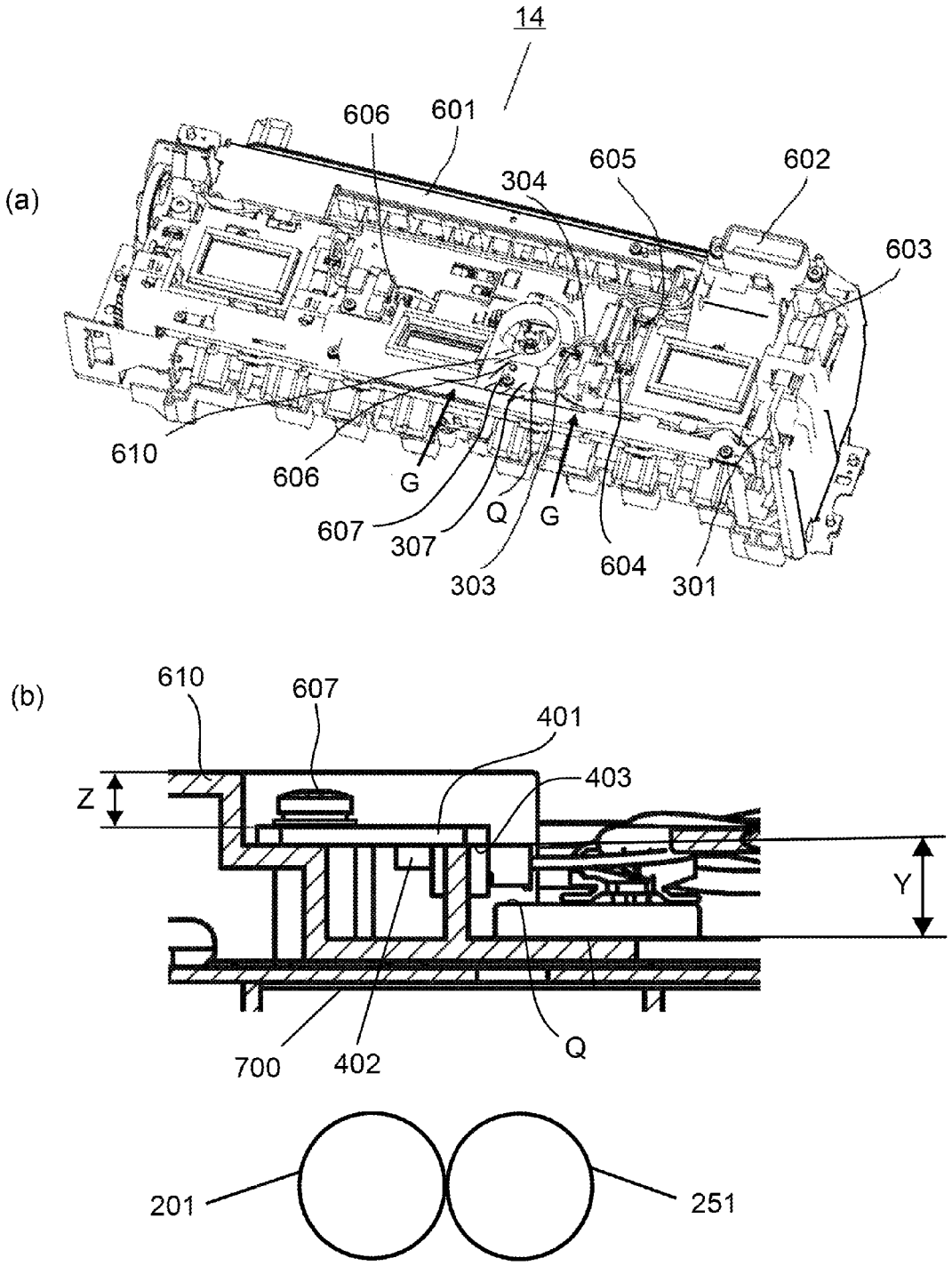
In FIG. 8, (a) is an illustration of mounting of the IC chip substrate to a fixing device, and (b) is a sectional view of mounting of the IC chip substrate as an electronic component.

In FIG. 8, (b) shows a G-G cross section of 8(*a*) of FIG. 8. The IC chip 402 and the connector 403 on the electric substrate 401 as the base of the IC chip substrate 307 are mounted toward a direction in which these members are out of sight (not exposed) from an outer appearance of the fixing device 14. Specifically, the IC chip substrate 307 is disposed in the following manner.

That is, in (b) of FIG. 8, the shielding member 700 for shielding a space between the IC chip 402 as the storing element and the pair of rotatable members (the fixing film 201 and the pressing roller 251) which form the nip is provided. Further, the electric substrate 401 is fixed to the shielding member 700 by a fixing means so that the IC chip 402 is portioned between the shielding member 700 and the electric substrate 401 as the electronic circuit substrate of the IC chip substrate 307 (FIG. 4).

As the fixing means, for example, a means including a through hole provided in the electric substrate 401 as the electronic circuit substrate, a screw hole provided in the shielding member 700, and a screw which passes through the through hole and which is fastened to the screw hole are provided.

Here, as described above with reference to (c) of FIG. 7, the connector 403 is of the snap-fitting type, and therefore, is not disconnected even when the bundle wire is pulled. Further, the height difference Y is 10 mm, and therefore, in a state in which the IC chip substrate 307 is mounted to the shutter unit 601, even when the bundle wire is intended to be pulled out, there is no space in which the snap-fitted portion 406 of the connector 403 is disconnected and thus it is impossible to pull out the bundle wire.

During exchange of the fixing film unit 310, similarly as in the First Embodiment, the IC chip substrate 307 is required to be demounted from the shutter unit 601 by demounting a fixing screw 607. Accordingly, during the exchange of the fixing film unit 310, also the IC chip substrate 307 is always demounted and collected from the shutter unit 601 simultaneously with the IC chip substrate 307. Then, as desired, the bundle wire and the IC chip substrate 307 (including the connector 403) are separated from each other, so that the information stored in the IC chip substrate 307 is retrieved.

According to this embodiment, in the case where the fixing device 14 is demounted from the image forming apparatus main assembly 100*a* and the part for maintenance or the like is exchanged, the service person is prevented from being accidentally touched on the IC chip 402, weak against impact (shock), with one's hand or a tool, so that it is possible to prevent breakage of the IC chip 402 resulting from the impact.

Modified Embodiments

Preferred embodiments of the present invention were described above, but the present invention is not limited thereto but may also be variously modified or changed within the scope of thereof.

Modified Embodiment 1

In the above-described embodiments, the IC chip substrate 307 included the electric substrate 401 as the base, and the IC chip 402 and the connector 403 were mounted on the electric substrate 401, but a constitution using no connector 403 may also be employed. That is, a constitution in which the film thermistor 211 disposed inside the fixing film 201 and the bundle wires 303 and 304 connected with the film thermistor 211 come out of the inside of the fixing film 201, and in which the bundle wires 303 and 304 are connected with the IC chip substrate 307 without the connector 403, may also be employed.

Modified Embodiment 2

In the above-described embodiments, as the periodic exchange unit or the periodic exchange part in the fixing device 14, the fixing film unit 310 or the temperature detecting element (thermistor) was described, but the periodic exchange unit or part may also be the pressing roller 251 or the like. Further, in the present invention, the member to be exchanged as the periodic exchange unit or part is not limited to members constituting the fixing device 14, but may also be members, including the photosensitive drum 1, constituting the image forming portion.

Modified Embodiment 3

In the above-described embodiments, as regards the first and second rotatable members forming the nip in the fixing device, the case where the endless belt was provided on the first rotatable member was described, but the endless belt was provided on the second rotatable member. Further, the endless belt may also be provided on both of the first and second rotatable members.

Further, the case where of the first and second rotatable members forming the nip in the fixing device, the first rotatable member as the pressing roller was pressed was described. However, the present invention is not limited thereto, but is similarly applicable to also the case where the second rotatable member as an opposing member, not the pressing member is pressed by the first rotatable member.

Modified Embodiment 4

In the above-described embodiments, as the pressing member, the pressing roller was used, but the present invention is not limited thereto, but may also be applicable to a flat plate-shaped pressing pad fixed as the pressing member.

Modified Embodiment 5

In the above-described embodiments, as the image heating apparatus, the fixing device for fixing the unfixed toner image on the recording material was described as the example, but the present invention is not limited thereto. In order to improve a glossiness of the image, the present invention is also similarly applicable to a device for heating and pressing the toner image temporarily fixed on the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-170394 filed on Aug. 31, 2015, which is hereby incorporated by reference herein in its entirety.

What is claimed is:

1. An image heating unit detachably mountable to an image forming apparatus, the image heating unit comprising:

a pair of rotatable members configured to form a nip for heating a toner image formed on a recording material;

an outermost wall positioned outside said rotatable members; and an electrical substrate including a storing element, wherein said electrical substrate is mounted on an outer surface of said outermost wall so that said storing element faces an outer surface of said outermost wall, with a predetermined gap being provided between said storing element and said outermost wall.

2. An image heating unit according to claim 1, wherein said electrical substrate includes a connector on a surface where said storing element is provided.

3. An image heating unit according to claim 1, wherein said electrical substrate includes a preventing portion configured to prevent reverse mounting thereof on said outermost wall.

4. An image heating unit according to claim 3, wherein said preventing portion includes a first hole configured to position said electrical substrate relative to said outermost wall, and a second hole configured to fasten said electrical substrate to said outermost wall with a screw, said second hole being different in size from said first hole.

5. An image heating unit according to claim 1, wherein in said storing element, operation hysteresis of said image heating unit is stored.

6. An image heating unit according to claim 1, further comprising an electrical contact electrically connectable with the image forming apparatus, and a wiring portion configured to electrically connect said electrical contact and said electrical substrate with each other.

* * * * *